US005839975A

United States Patent [19]

Lundberg

[11] Patent Number: 5,839,975

[45] Date of Patent: Nov. 24, 1998

[54] ARCH REINFORCED GOLF CLUB HEAD

[75] Inventor: Harry C. Lundberg, Ramsey, N.J.

[73] Assignee: Black Rock Golf Corporation, Englewood, Colo.

[21] Appl. No.: 950,425

[22] Filed: Oct. 15, 1997

Related U.S. Application Data

[60] Provisional application No. 60/035,669 Jan. 22, 1997.

[51] Int. Cl. [6] ..... A63B 53/04

[52] U.S. Cl. ..... 473/346

[58] Field of Search ..... 473/324, 329, 473/332, 345, 346, 350, 290, 291

[56] References Cited

U.S. PATENT DOCUMENTS

| | | |
|---|---|---|
| D. 125,602 | 3/1941 | Wheeler et al. . |
| D. 215,314 | 9/1969 | Jackson . |
| D. 229,431 | 11/1973 | Baker . |
| D. 314,029 | 1/1991 | Allen . |
| D. 314,220 | 1/1991 | Allen . |
| D. 341,178 | 11/1993 | Rice et al. . |
| D. 344,997 | 3/1994 | Allen . |
| D. 365,131 | 12/1995 | Edwards et al. . |
| D. 377,068 | 12/1996 | Stites, III . |
| 572,436 | 12/1896 | Mills . |
| 1,459,810 | 6/1923 | Wills . |
| 1,556,473 | 10/1925 | Ballou . |
| 1,568,888 | 1/1926 | Dunn . |
| 1,582,836 | 4/1926 | Link . |
| 1,587,758 | 6/1926 | Charavay . |
| 1,658,581 | 2/1928 | Tobia . |
| 1,664,257 | 3/1928 | McCullough . |
| 1,673,973 | 6/1928 | Drevitson . |
| 1,678,637 | 7/1928 | Drevitson . |
| 1,720,867 | 7/1929 | Webster et al. . |
| 1,930,342 | 10/1933 | Graham . |
| 2,046,191 | 6/1936 | Smith . |
| 2,083,189 | 6/1937 | Crooker . |
| 2,121,718 | 6/1938 | Sweetland . |
| 2,429,351 | 10/1947 | Fetterolf . |
| 2,482,015 | 9/1949 | McConnell . |
| 2,628,100 | 2/1953 | Beebe . |
| 3,077,350 | 2/1963 | Koorland . |
| 3,111,322 | 11/1963 | English . |
| 3,637,218 | 1/1972 | Carlino . |
| 3,652,093 | 3/1972 | Reuter, Jr. . |
| 3,847,399 | 11/1974 | Raymont . |
| 3,873,094 | 3/1975 | Sebo et al. . |
| 4,076,254 | 2/1978 | Nygren . |
| 4,214,754 | 7/1980 | Zebelean . |
| 4,313,607 | 2/1982 | Thompson . |
| 4,355,810 | 10/1982 | Rydeck . |
| 4,438,931 | 3/1984 | Motomiya . |
| 4,461,481 | 7/1984 | Kim . |
| 4,511,147 | 4/1985 | Olsen . |
| 4,535,990 | 8/1985 | Yamada . |
| 4,602,787 | 7/1986 | Sugioka et al. . |
| 4,618,149 | 10/1986 | Maxel . |
| 4,635,974 | 1/1987 | Moussaian . |
| 4,664,388 | 5/1987 | Huber . |
| 4,679,792 | 7/1987 | Straza et al. . |

(List continued on next page.)

FOREIGN PATENT DOCUMENTS

| | | |
|---|---|---|
| 211781 | 1/1957 | Australia . |
| 52-49130 | 4/1977 | Japan . |
| 5-103847 | 4/1993 | Japan . |
| 15597 | of 1905 | United Kingdom . |

*Primary Examiner*—Sebastiano Passaniti
*Attorney, Agent, or Firm*—Dorsey & Whitney LLP

[57] ABSTRACT

A golf club head made of metal has a hollow construction with a pair of arcuate reinforcing ribs extending in horizontal and vertical planes with the arcuate ribs terminating at the striking plate of the golf club where a base structure of reinforcing ribs interconnect the ends of the arcuate ribs. The rib structure is molded integrally with the walls of the hollow club head and function to desirably reinforce the club head to prevent collapse or other distortion while providing a relatively large sweet spot and preventing undesired torque on the club head when a golf ball is hit at an off center location on the striking plate.

7 Claims, 3 Drawing Sheets

U.S. PATENT DOCUMENTS 4,681,321 7/1987 Chen et al. .
4,681,322 7/1987 Straza et al. .
4,730,830 3/1988 Tilley .
4,756,534 7/1988 Thompson .
4,811,949 3/1989 Kobayashi .
4,815,739 3/1989 Donica .
4,852,879 8/1989 Collins .
4,919,430 4/1990 Antonious .
4,930,781 6/1990 Allen .
4,932,658 6/1990 Antonious .
4,938,470 7/1990 Antonious .
4,940,236 7/1990 Allen .
4,944,515 7/1990 Shearer .
4,964,640 10/1990 Nakanishi et al. .
4,988,104 1/1991 Shiotani et al. .
5,000,454 3/1991 Soda .
5,014,993 5/1991 Antonious .
5,054,784 10/1991 Collins .
5,060,951 10/1991 Allen .
5,125,662 6/1992 Antonious .
5,180,166 1/1993 Schmidt et al. .
5,295,689 3/1994 Lundberg .
5,301,941 4/1994 Allen .
5,356,138 10/1994 Chen et al. .
5,380,010 1/1995 Werner et al. .
5,405,139 4/1995 Gagarin .
5,427,376 6/1995 Cummings et al. .
5,451,056 9/1995 Manning .
5,480,146 1/1996 Comer .
5,482,279 1/1996 Antonious .
5,501,453 3/1996 Hurst .
5,501,459 3/1996 Endo .
5,516,106 5/1996 Henwood .
5,518,242 5/1996 Mahaffey et al. .
5,524,331 6/1996 Pond .
5,527,034 6/1996 Ashcraft et al. .
5,536,006 7/1996 Shieh .
5,540,437 7/1996 Bamber .
5,544,885 8/1996 Besnard et al. .
5,547,194 8/1996 Aizawa et al. .
5,547,426 8/1996 Wood .
5,547,427 8/1996 Rigal et al. .
5,549,296 8/1996 Gilbert .
5,564,994 10/1996 Chang .
5,570,886 11/1996 Rigal et al. .
5,577,550 11/1996 Schmidt .
5,584,770 12/1996 Jensen .
5,586,948 12/1996 Mick .
5,586,949 12/1996 Aizawa .
5,599,021 2/1997 Lary et al. .

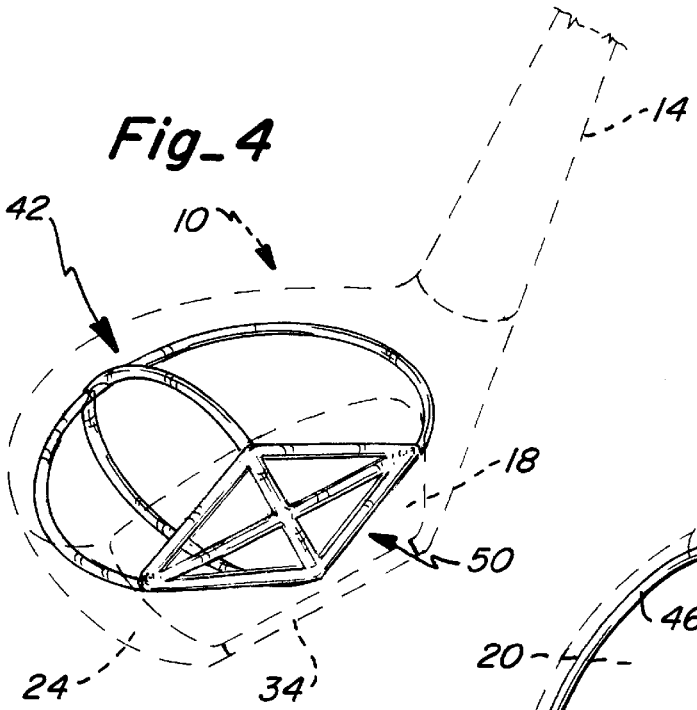
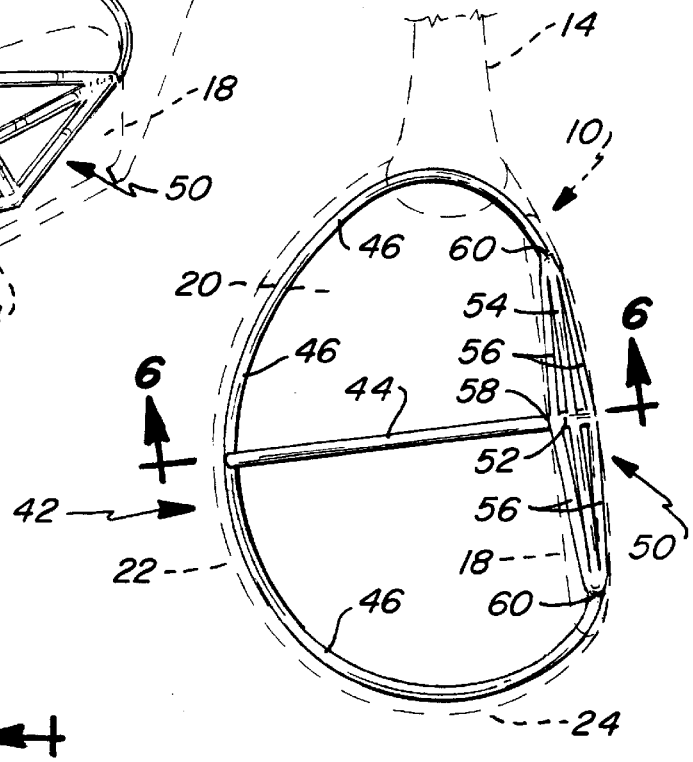
Fig_5
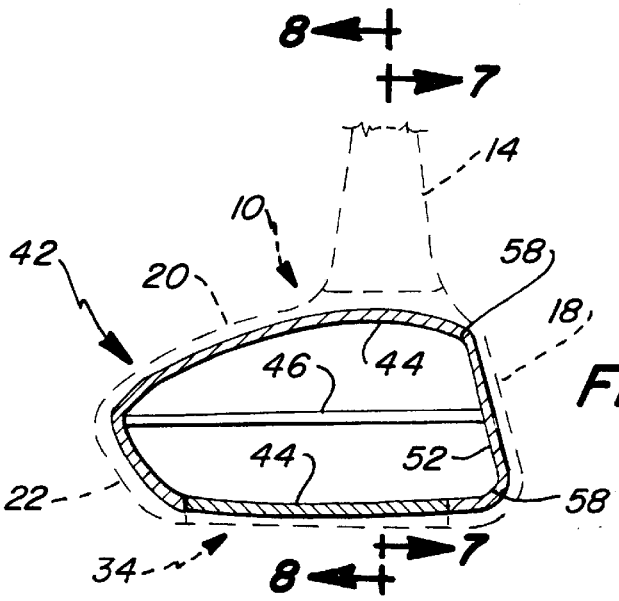
Fig_6

ARCH REINFORCED GOLF CLUB HEAD

CROSS-REFERENCE TO RELATED APPLICATIONS

This application is related to provisional application Ser. No. 60/035,669, filed Jan. 22, 1997, for Parabolic Arch Reinforced Golf Club Head and priority to that application is hereby claimed.

BACKGROUND OF THE INVENTION

1. Field of the Invention

The present invention relates to metal wood golf club heads and more particularly, to means for reinforcing such golf club heads.

2. Description of Relevant Art

The term "woods" in relation to golf clubs embraces a family of rather long, and shallow lofted clubs that were previously almost exclusively made of persimmon or laminated maple wood. The family includes drivers and fairway woods with fairway woods having a greater loft than drivers and having shafts that are somewhat shorter. Wood clubs made of persimmon and laminated maple have lost popularity to metal woods that are typically hollow in construction and might be made of various metals such as stainless steel, aluminum or titanium. Stainless steel clubs are typically made of either stainless 304 or stainless 17-4 with the densities of these stainless steel heads being approximately 8.02 g/cm$^3$ and 7.75 g/cm$^3$ respectively. Aluminum metal as used in golf club heads conventionally has a density of 2.72 g/cm$^3$ while titanium as used in golf club heads usually has a density of 4.50 g/cm$^3$.

As will be appreciated, if metal wood golf clubs were made of solid metal, they would be far too heavy and as a result, virtually all metal woods are primarily hollow.

The problems associated with hollow heads are numerous as are the attempts to overcome these problems. Some of the more common problems experienced with hollow metal woods are that the face of the club collapses upon repetitive impact with golf balls or the hollow shell behind the face crumples or fractures. One solution to the collapsing striking face has been to include reinforcement behind the face, but all too often this has led to an uneven dispersion of energy through the club head. More recently, several developments have occurred which have provided more satisfactory remedies to the above problems.

Particularly, new metal alloys have come into vogue, particularly duraluminum and a titanium alloy including aluminum and vanadium (commonly called Ti-6-4). While none of these alloys eliminate the distortion of the club head, they have assisted in resisting the overall compression of the heads during impact with the golf ball and minimize the possibility of crumpling and fracture of the hollow metal heads.

Another simultaneous evolution in the design of golf club heads is an enlargement in the head in the belief that the broader the head, particularly in hollow clubs which are of necessity perimeter weighted, the straighter the golf ball flight will be when the ball impacts the striking face at an off center location. Volumes of 250 cm$^3$ and more are now common in hollow golf club heads. As will be appreciated even with low density metal alloys, wall thicknesses must be thinned and design considerations therefore continue to be of concern to keep the weight of the club within reasonable ranges.

Furthermore, longer clubs, having up to fifty inch shafts, are also reaching the market. To keep moments of inertia of such a driver to a tolerable level due to increased club head speeds, the heads must weigh as little as approximately 180 grams. Further, such a head must be large in volume to counter the vision problems of perspective a player will have as he addresses the ball some three to seven inches further away than has been conventional with normal length shafts.

It can be seen that the recent trends in golf club design continue to press in the direction of attenuated wall thicknesses to solve the aforenoted problems and the issues that are raised with longer shafts and bigger golf club heads.

Thus, it is an objective of this invention to decrease the tendency of the golf club head to be deformed when impacting golf balls. It is a further objective to reduce the wall thickness of the several sections comprising the head such that a finite amount of mass can be liberated and judiciously moved to other locations.

SUMMARY OF THE INVENTION

The golf club head of the present invention is integrally molded with parabolic reinforcement in the form of an arcuate ribbed primary superstructure and a base superstructure that uniquely uses the interior wall portion of the head to balance and minimize weight and to provide superior reinforcement. The reinforcement is not a separate structure but instead is integrally molded into the walls of the head. The reinforcement creates unique superstructures wherein each superstructure or reinforcing rib protrudes from the interior surface of the club head walls and into the predominantly hollow club head interior. The cross-section of the reinforcing ribs is preferably semi-circular.

The primary superstructure includes a first arcuate rib integrally molded perpendicular to horizontal when the club is resting normally on the ground, and forms a substantially parabolic arch. Hence, the first arcuate rib runs along the interior of the top wall of the club head to the relatively narrow rear of the club and returns along the sole plate.

A second arcuate rib also forms part of the primary superstructure and is integrally molded parallel to horizontal and is, therefore, at right angles to the first arcuate rib. The second arcuate rib runs along the side wall of the club head, which includes a toe portion, a rear portion, and a heel portion, so that the two arcuate ribs cross at the rear of the club head.

The base superstructure protrudes from the interior surface of the striking plate or face of the golf club head and is comprised of a vertical rib, a horizontal rib, and additional supplementary ribs which interconnect the ends of the aforenoted first and second arcuate superstructures. The base superstructure predominantly prevents distortion of the club head by interconnecting the ends of the arcuate ribbed superstructures. The vertical rib of the base superstructure protrudes from the interior surface of the striking plate and runs from the top wall to the sole plate. The vertical rib passes substantially through the center of the striking face and interconnects the ends of the first arcuate ribbed superstructure. The horizontal rib of the base superstructure protrudes from the interior surface of the striking face and runs horizontally across the striking plate so as to interconnect the ends of the second arcuate ribbed superstructure.

As mentioned, supplementary ribs connect the ends of the first arcuate ribbed superstructure to the ends of the second arcuate ribbed superstructure so that four contiguous triangles are defined by the base superstructure.

The arcuate primary superstructure ribs and the base superstructure ribs cooperate in resisting compression and distortion of the body of the club head, irrespective of whether or not the player impacts the golf ball on the center of the club face or has a mis-hit at an off center location.

Other features and advantages of the present invention will become apparent from the following detailed description in conjunction with the accompanying drawings.

BRIEF DESCRIPTION OF THE DRAWINGS

FIG. 4 is an isometric view of the club head of the present invention with the outer shell of the club head shown in dashed lines and the primary and base ribbed superstructures shown solid lines and viewing the club head from the front.

FIG. 5 is a top plan view of the club head as shown in FIG. 4, again with the outer shell shown in dashed lines and the primary and ribbed superstructures shown in solid lines.

FIG. 6 is a section taken along line 6—6 of FIG. 5.

DESCRIPTION OF THE PREFERRED EMBODIMENT

Figure 1:
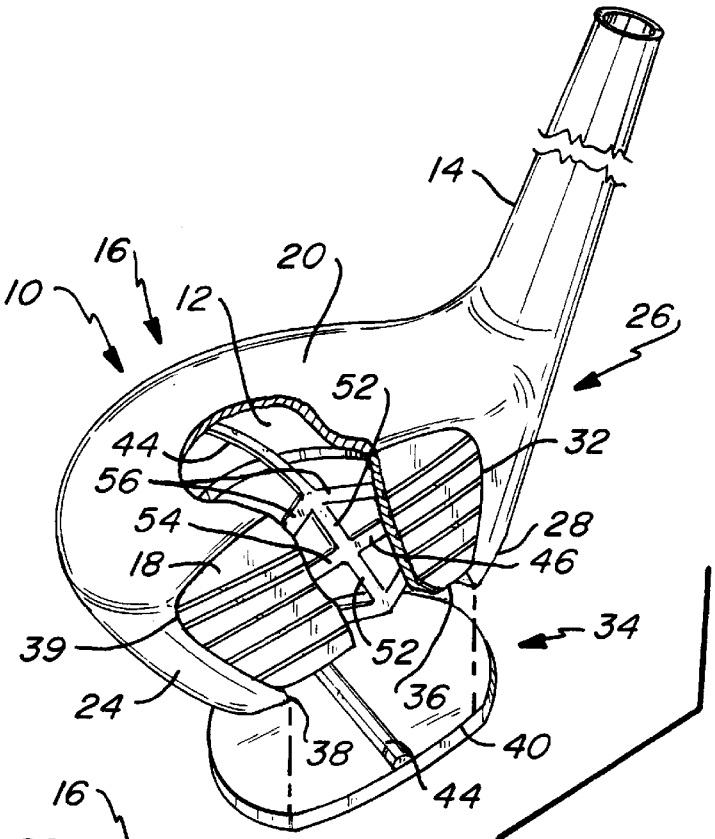
FIG. 1 is a fragmentary isometric view of a golf club head incorporating the features of the present invention with the sole plate displaced from the upper body portion of the club head with the club head being viewed from the front.

The golf club head 10 of the present invention can be seen in FIGS. 1 through 8 to comprise a hollow body 12 having a neck 14 near the heel of the body to which a golf shaft (not shown) can be conventionally connected. The golf club head can be made of any one of the known metals from which golf club heads are made, such as stainless steel, aluminum alloys or Ti-6-4. The golf club head is typically investment cast in accordance with the well known "lost wax process".

If the head 10 is made from stainless steel 304, the preferred metal density is 7.02 g/cm$^3$, while if the club head is made of stainless steel 17-4, the preferred density is 7.75 g/cm$^3$. If an aluminum alloy is used, the preferred density is 2.72 g/cm$^3$, while use of Ti-6-4 would have a preferred density of 4.50 g/cm$^3$.

Figure 2:
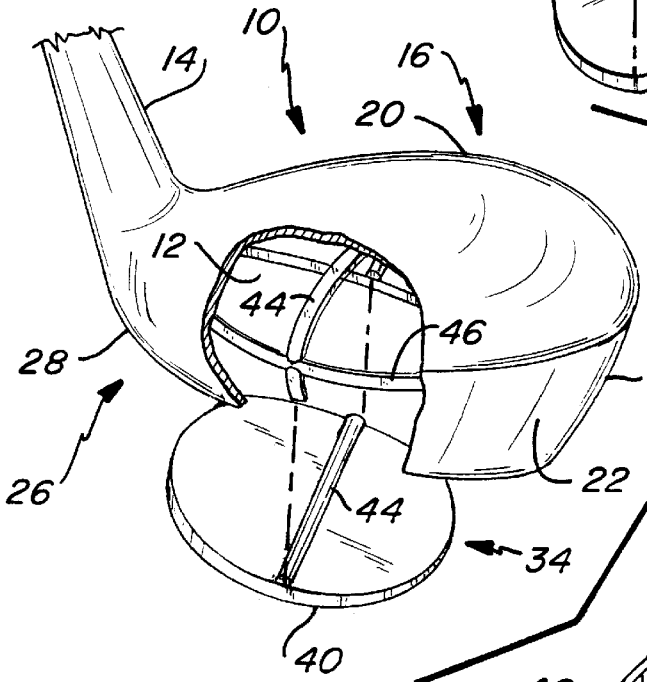
FIG. 2 is a fragmentary isometric similar to FIG. 1 with the golf club head being viewed from the rear and, again, with the sole plate being displaced from the upper body portion.

The hollow body 12 of the club head 10 as best seen in FIGS. 1 and 2 includes an upper body portion 16 comprised of a relatively flat striking face or plate 18, an arched top wall 20, and a curved side wall 22. The curved side wall has a toe portion 24, a rear portion 26, and a heel portion 28. The side wall extends from the toe edge 39 of the striking plate 18 to the heel edge 32 of the striking plate while following the perimeter of the top wall 20. This entire upper body portion is preferably integrally molded. The neck 14 may be molded or welded into the top wall adjacent to the location at which the side wall intersects the heel edge of the striking plate with the neck consisting of a generally hollow cylindrical extension sized to slidably receive the tip of a golf club shaft.

The golf club head further includes a sole plate 34 which is a relatively flat plate positioned in spaced confronting relationship with the top wall and extending rearwardly from the lower edge 36 of the striking plate 18 to the rear portion 26 of the side wall. The sole plate is preferably formed separately from the upper body portion 16 of the club head and is later welded to the upper body portion along its leading edge 38 to the lower edge of the striking plate and along its remaining peripheral edges 40 to the lower edge of the side wall 22.

While the relative thicknesses of the walls of the club head can vary depending upon the metal used, in the preferred embodiment of a club head made of Titanium 6-4 designed for use on a fifty inch golf club shaft and having a total volume of 290 to 300 cc, the top and side walls would preferably have a thickness of approximately 1.0 mm, the sole plate 1.1 mm and the striking plate 2.85 cm and the weight would be 178 grams.

Each of the top wall, side wall, striking plate, and sole plate as best seen in FIGS. 3 through 8 has integrally formed therewith a rib or ribs which in combination cooperate to define primary and base ribbed superstructures to reinforce the club head thereby preventing collapse or distortion of the club head upon impact with a golf ball and in desirably dispersing the impact forces throughout the club head. For purposes of disclosure, the ribbing is illustrated removed from the club head in FIG. 3, but it is understood that the primary superstructure and base structure do not comprise distinct and separate components from the afore-described upper body and sole plate, but rather are integral with associated portions of the club head body and sole plate and are only shown removed for purposes of description.

The primary superstructure 42, as best seen in FIGS. 3 through 6, consists of two arcuate ribs which are somewhat parabolic in configuration with a first arcuate rib 44 extending in a substantially vertical plane and the second arcuate rib 46 extending in a substantially horizontal plane. The first arcuate rib extends from a centered location adjacent the front edge of the top wall 20 along the top wall toward the rear of the golf club where it crosses the rear portion 26 of the side wall 22 and is subsequently continuous along a centered path across the sole plate 34 to a centered location of the leading edge of the sole plate. The second arcuate rib 46 extends along the side wall 22 from a location at the toe edge 39 of the striking plate to a location at the heel edge 32 of the striking plate. As will be appreciated, the first and second arcuate ribs intersect perpendicularly to each other at the rear portion 26 of the side wall. It will be appreciated that with the exception of the portion of the first arcuate rib 44 that extends across the sole plate 34, the arcuate ribs are continuous since they are molded into the walls of the integral upper body portion 16 of the club head. When the sole plate is welded to the upper body portion of the club head, the portion of the arcuate rib 44 extending across the sole plate is aligned with, and is effectively continuous with, the remaining portion of the first arcuate rib.

Figure 3:
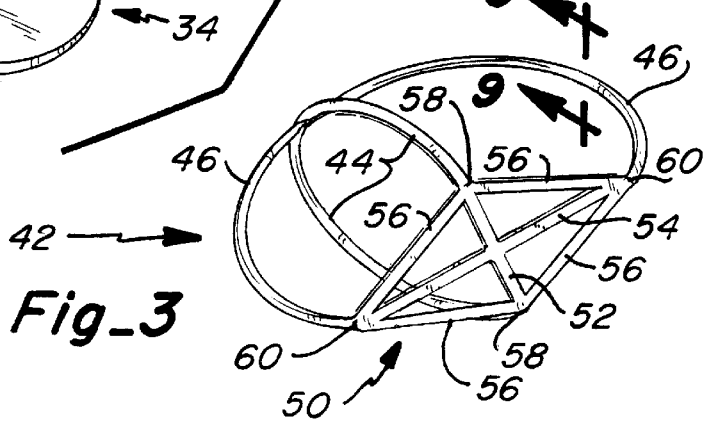
FIG. 3 is a diagrammatic view illustrating the primary ribbed superstructure and the base ribbed superstructure removed from the club head, it being understood that the ribs are, in fact, integral with the walls of the club head body.
Figure 7:
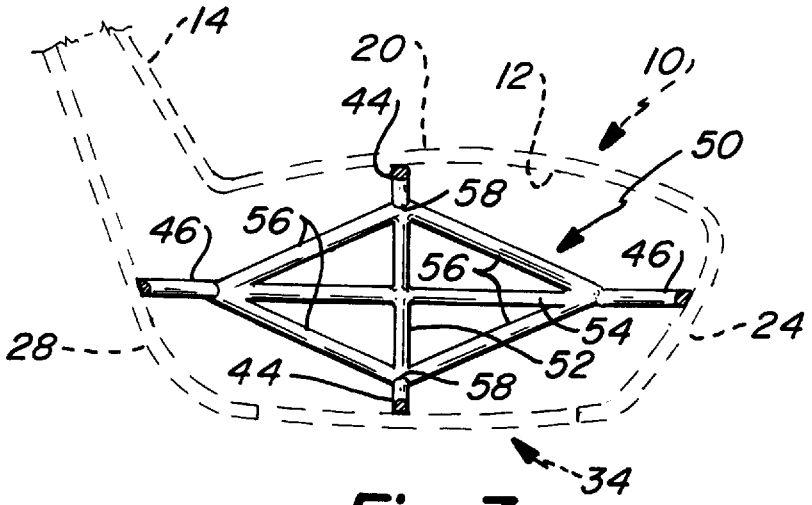
FIG. 7 is a section taken along line 7—7 of FIG. 6.
Figure 8:
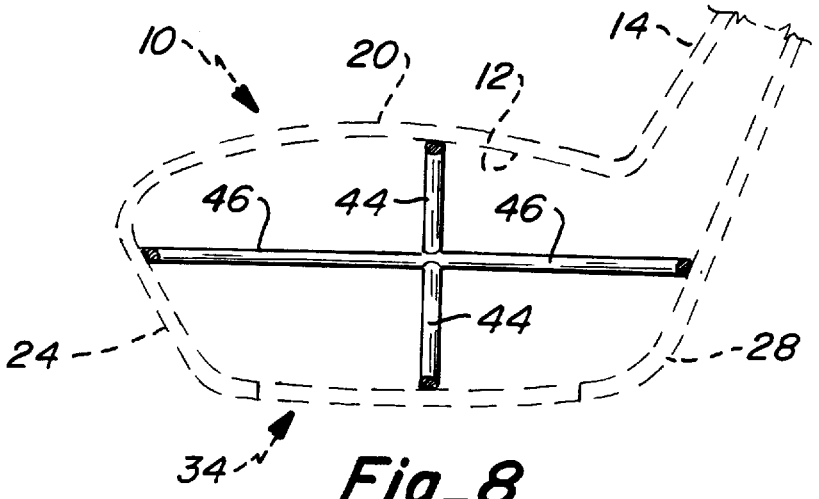
FIG. 8 is a section taken along line 8—8 of FIG. 6.

The base superstructure 50, as best seen in FIGS. 3, 4 and 7, is formed on the internal face of the striking plate 18 and includes a straight vertical rib 52, a straight horizontal rib 54, and four supplementary straight ribs 56 interconnecting the ends of the vertical and horizontal ribs 52 and 54 respectively. The upper and lower ends of the vertical rib 52 are integral and continuous with the ends 58 of the first arcuate rib 44, while the ends of the horizontal rib 54 are integral and continuous with the ends 60 of the second arcuate rib 46 with the vertical and horizontal ribs intersecting at approximately the center of the striking plate. The supplementary ribs 56 in the base structure connect each end of the first arcuate rib 44 to the ends of the second arcuate rib 46. Each rib in the base superstructure is straight and therefore the ribs define in combination four contiguous right triangles. The triangles defined by the base superstructure prevent distortion of the ribs in the base superstructure and the striking plate during impact with a golf ball and the base superstructure in whole provides support for the first and second arcuate ribs of the primary superstructure.

As will be appreciated, the arcuate configuration of the first and second arcuate ribs 44 and 46 respectively employ the physical principals of the arc in resisting club head compression or deformation. In the case where the club head strikes a golf ball at the center of the striking plate 18, the two arcuate ribs act jointly to resist distortion and deformation. In the event of a mis-hit at an off center location on the striking plate, the combination of the four triangles in the base superstructure 50 dampen the force by virtue of the enlarged sweet spot or reinforced area that they form. The forces generated by an off center hit are thus transmitted to the nearest of the first or second arcuate ribs and thereafter transmitted toward the rear of the club head where the load can be shared between the arcuate ribs.

The primary superstructure 42 and the base superstructure 50 of the present invention resist distortion of the club head, maximizing the efficiency or the transfer of energy from the club head to the ball while minimizing problems related to off center hits on the striking plate. The design further permits judicious thinning of the walls defined by the hollow club head such that the center of gravity of the head is repositioned toward the rear, providing a higher launch angle of the ball, without increasing the loft of the striking plate, the loft can be lessened which as an alternative, allows a more efficient transfer of energy from the club head to the ball, it being fundamental knowledge that the more vertical the striking plate, the more efficient the transfer of energy to the golf ball.

Figure 10:
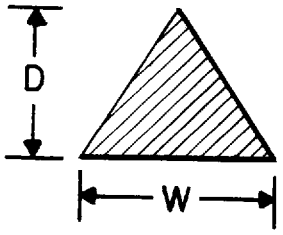
FIG. 10 is a cross-section similar to FIG. 9 through an alternative configuration of a rib in the primary or base ribbed superstructures.

While the ribs in both the primary and base superstructure could be formed of different cross-sectional configurations, it is preferable that they have a semi-circular cross section as shown in FIG. 7. An alternative might be a triangular cross section as shown in FIG. 10 but the triangular configuration is not as advantageous for reasons to be discussed hereafter. It is further desirable that the ribs have a depth D that is no greater than the width W as this provides the desired reinforcement and structural rigidity to the club head without adding unnecessary weight which would otherwise require further thinning of the wall thicknesses of the club head. While the preferred cross section is semi-circular, the ribs could be quadrilateral in cross section but, again, the depth would preferably be no greater than the width of the ribs so as to give the desired rigidity to the club head without adding unnecessary weight.

Figure 9:
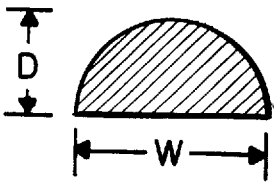
FIG. 9 is a cross-section through one preferred embodiment of a rib in the primary or base superstructures.

It will be appreciated from the above that a golf club head 10 has been described which allows the head to be made of desired metals while permitting the golf club incorporating the head to have an overall weight and swing weight in a desirable range. The size of the reinforcing ribs can be varied depending upon the desired weight and size of the club head but preferably the ribs have a depth that is no greater than the width, with the width, for example, being approximately 4.4 mm. In a semi-circular configuration as shown in FIG. 9 the depth would therefore be approximately 2.2 mm while in the configuration shown in FIG. 10 the depth would be approximately 4.4 mm. Increasing the cross-sectional size of the ribs improves the resistance to club head deformation and improves the transfer of energy from the club head to the ball but adds weight to the club head.

As mentioned previously, the desired cross-sectional configuration for the rib is semi-circular inasmuch as the stiffness provided by the rib, which might be referred to as the section modulus, is greater per unit size than in other geometric configurations. By way of example, the section modulus for a semicircular rib is $r^3/24\times C$ where r is the radius of the semi-circle and C is a constant. It will, therefore, be appreciated that very small changes in the radius have a dramatic effect on the stiffness of the rib and, thus, the reinforcement of the club head without adding significant weight. The section of modulus for a triangle varies by the square of the height of the triangle given a constant base and, therefore, while the triangular configuration does provide desired stiffening, it is not as efficient a system for stiffening as is the semi-circle.

It has been found in a golf club head made in accordance with the desired parameters identified above for a titanium 6-4 metal, that if the club head is not reinforced, there will be approximately 50% failures of the club head when normally impacted with a golf ball. If the golf club head is reinforced with ribs in accordance with the present invention that are of semi-circular cross section having a 2.2 mm radius, the number of golf club failures drops to nearly zero while only adding 3 grams of weight to the normally 178 gram club head. Accordingly, due to the reinforcement design of the present invention, a golf club head, can be made to dependably resist, without failure to the golf club head, the normal impact of golf balls with minimal addition of weight. As mentioned, when the ribs are semi-circular in cross-section, the efficiency in obtaining the desired strength while keeping the weight at a minimum is optimized.

Use of the arcuate and somewhat parabolic rib superstructures in combination with the base superstructure also enlarges the sweet spot while preventing torque in the club head and at the same time desirably prohibits collapse or other distortion of the club head. As also mentioned, the design of the club head allows the center of gravity to be positioned toward the rear of the club head so as to provide higher launch angles of the golf ball without increasing the loft of the striking plate.

Although the present invention has been described with a certain degree of particularity, it is understood that the present disclosure has been made by way of example, and changes in detail or structure may be made without departing from the spirit of the invention as defined in the appended claims.

I claim:

1. A golf club head comprising:

a hollow body including a top wall, a sole plate spaced from and opposite said top wall, a striking plate interconnecting said top wall and sole plate along forward edges thereof, and an arcuate side wall interconnecting said top wall, sole plate and striking plate, said side wall defining toe, heel and rear portions, said top wall, side wall, striking plate and sole plate being integrated to define closure to said hollow body, a reinforcing ribbed primary superstructure with first and second arcuate ribs integral with said walls and sole plate, said first arcuate rib protruding inwardly and extending across said top wall, said rear portion of the side wall and said sole plate and having ends adjacent to upper and lower positions on said striking plate, said second arcuate rib comprised of an inwardly protruding rib extending along said side wall in a plane substantially perpendicular to a plane encompassing said first arcuate rib, said first and second arcuate ribs intersecting at said back portion of the side wall and said second arcuate rib having ends adjacent to heel and toe positions on said striking plate, and a base superstructure protruding inwardly from said striking plate interconnecting the ends of said first and second arcuate rib structures, all of said ribs having a depth dimension that is no greater than the width dimension.

2. The golf club head of claim 1 wherein said ribs are of semi-circular cross-section.

3. The golf club head of claim 1 wherein said ribs are triangular in cross-section.

4. The golf club head of claim 1 wherein said base superstructure includes a substantially vertical rib interconnecting the ends of said first arcuate rib and a second substantially horizontal rib interconnecting the ends of said second arcuate rib.

5. The golf club head of claim 4 wherein said base rib superstructure further includes supplementary ribs interconnecting each end of said first arcuate rib to each end of said second arcuate rib.

6. The golf club head of claim 1 wherein said ribs are of non-rectangular cross-section.

7. The golf club head of claim 1 wherein said depth dimension is approximately 2.2 mm.

* * * * *